US012734433B2

(12) United States Patent
Kang et al.

(10) Patent No.: US 12,734,433 B2
(45) Date of Patent: Sep. 15, 2026

(54) GAME METHOD FOR GAME MACHINE FOR TICKET OUTPUT

(71) Applicant: KOMUSE Co., Ltd., Paju-si (KR)

(72) Inventors: Nam Ho Kang, Gimpo-si (KR); Byeong Soo Seo, Goyang-si (KR); Ryeol Baek, Goyang-si (KR); So Ran Kim, Goyang-si (KR)

(73) Assignee: KOMUSE CO., LTD., Paju-si (KR)

( * ) Notice: Subject to any disclaimer, the term of this patent is extended or adjusted under 35 U.S.C. 154(b) by 669 days.

(21) Appl. No.: 18/312,659

(22) Filed: May 5, 2023

(65) Prior Publication Data

US 2024/0325871 A1 Oct. 3, 2024

(30) Foreign Application Priority Data

Mar. 28, 2023 (KR) ..... 10-2023-0040561

(51) Int. Cl.

| | |
|---|---|
| ***A63F 7/40*** | (2006.01) |
| ***A63F 7/24*** | (2006.01) |
| ***A63F 7/30*** | (2006.01) |
| ***A63F 11/00*** | (2006.01) |

(52) U.S. Cl.

CPC ..... *A63F 7/40* (2013.01); *A63F 7/249* (2013.01); *A63F 7/30* (2013.01); *A63F 11/0051* (2013.01); *A63F 2007/4068* (2013.01); *A63F 2011/0058* (2013.01)

(58) Field of Classification Search

CPC .... A63F 7/40; A63F 7/249; A63F 7/30; A63F 11/0051; A63F 2007/4068; A63F 2011/0058

See application file for complete search history.

(56) References Cited

U.S. PATENT DOCUMENTS

| | | | | |
|---|---|---|---|---|
| 5,071,127 | A * | 12/1991 | Bromley | A63F 7/0005 194/344 |
| 5,425,536 | A * | 6/1995 | Kelly | G07F 17/3297 273/108 |
| 5,556,093 | A * | 9/1996 | Lankiewicz | A63F 7/3603 273/127 R |
| 10,603,573 | B1 * | 3/2020 | Kang | A63F 7/307 |
| 12,090,413 | B1 * | 9/2024 | Eddy | A63F 7/30 |
| 2010/0044960 | A1 * | 2/2010 | Nagayama | A63F 7/00 273/138.3 |

(Continued)

FOREIGN PATENT DOCUMENTS

KR 10-1917814 B1 11/2018

*Primary Examiner* — Eugene L Kim
*Assistant Examiner* — Saba N. Ali
(74) *Attorney, Agent, or Firm* — You & IP, LLC

(57) ABSTRACT

Disclosed is a game method for a game machine for ticket output in which a puck dropped onto a rail unit through a puck feeder slides toward one end portion of the rail unit, in this case, when the puck is hit by a hitting device such that the puck is discharged to the other end portion of the rail unit, the puck slides along a score acquisition unit in proportion to a hitting force of the hitting device to fly into any one of a plurality of score holes, the number of tickets corresponding to the score hole into which the puck flies is displayed on a ticket output amount display, and the number of tickets displayed on the ticket output amount display is output trough a ticket output unit.

7 Claims, 5 Drawing Sheets

(56) References Cited

U.S. PATENT DOCUMENTS

| | | | | |
|---|---|---|---|---|
| 2011/0183741 | A1* | 7/2011 | Smart | G07F 17/3251<br>273/138.3 |
| 2015/0209653 | A1* | 7/2015 | Warren, Jr. | F16P 1/02<br>473/111 |

* cited by examiner

GAME METHOD FOR GAME MACHINE FOR TICKET OUTPUT

CROSS-REFERENCE TO RELATED APPLICATION

This application claims priority to and the benefit of Korean Patent Application No. 10-2023-0040561, filed on Mar. 28, 2023, the disclosure of which is incorporated herein by reference in its entirety.

BACKGROUND

Field of the Invention

The present invention relates to a game method for a game machine for ticket output, and more particularly, to a game method for a game machine for ticket output in which a puck, which is dropped and supplied onto a rail unit by a puck feeder and positioned at one end portion of the rail unit, is hit by a hitting device so that the puck moves along the rail unit and flies into any one of a plurality of score holes.

Discussion of Related Art

In general, game vending machines are apparatuses from which designated prizes are obtained according to a result of winning or losing a game and which are each provided with a prize dispenser so that a user can obtain a greater sense of achievement for the purpose of enjoying a game.

In this case, in such game vending machines, since a result of winning or losing a game is determined according to a manipulation ability of a user, a user who enjoys the game can obtain both a sense of achievement and a prize.

Patent Document 1 relates to the conventional ball bump game apparatus, and more specifically, the conventional ball bump game apparatus includes a main body in which a viewing window is formed on a front surface, a shooting hole is formed in a lower end portion of the viewing window, and an operation switch is formed on an upper surface of a front end portion, a medal withdrawal unit installed inside the front surface of the main body to discharge medals through a medal withdrawal port of the main body, a game board which has a plate shape and is installed on an upper surface of the main body and in which a plurality of through-holes for discharging air are formed in an upper surface and a goal-in line and a goal-in zone are formed on an upper surface of a rear end portion, and a medal removal unit of which both end portions are slidably coupled to both end portions of the game board and which moves horizontally to move a shooting medal seated on the game board to an end portion of the game board and remove the shooting medal from the game board.

First, when a coin is inserted into a coin slot of the main body, the medal withdrawal unit operates to discharge a set number of shooting medals through the medal withdrawal port, and in this case, a user collects the shooting medals and places the shooting medals on the upper surface of the front end portion of the main body.

Here, the shooting medal is placed around the shooting hole and, in that state, after the goal-in zone or goal-in line of the game board is visually checked through the viewing window, when the shooting medal is shot with a user's finger, the shooting medal entering the shooting hole moves along the game board.

In this case, air is continuously sprayed through the through-holes of the game board, and accordingly, the shooting medal entering the game board slides toward the goal-in-line or goal-in zone in a state of being flown by the air sprayed from the through-holes.

When the shooting medal that slides on the game board reaches the goal-in-line or the inside of the goal-in zone, a set score is obtained and, in this case, the score obtained when the shooting medal in the goal-in zone is output as a score that is relatively higher than the score obtained when the medal reaches the goal-in-line.

When the shooting medal does not reach the goal-in-line or the goal-in zone, a user fails to obtain a score.

Thereafter, when a game is finished, a removal portion of the medal removal unit is moved downward to approach the upper surface of the game board and then pushes the shooting medal seated on the game board toward the end portion of the game board to remove the shooting medal from the game board.

However, in Patent Document 1, during an operation in which shooting medals seated around the shooting hole are consecutively shot using a user's finger, it may cause a pain in the user's finger. When a child or the elderly shoots the shooting medals, a shooting medal hitting force is greatly reduced to greatly reduce a possibility that the shooting medal reaches the goal-in line or goal-in zone on the game board. Due to a repetitive motion of shooting the shooting medals using a finger, a moving distance of the shooting medal may be easily determined, and since the shooting medal easily moves into the goal-in line or goal-in zone in a short time, an interest level of the game is greatly reduced. In particular, since a position of the goal-in-line or goal-in zone is covered by the medal removal unit, it is difficult to estimate the position of the goal-in-line and goal-in zone when hitting the shooting medal using a finger. Accordingly, there is a problem that there is a great inconvenience in the progress of the game, and the reliability of a product is lowered.

RELATED ART DOCUMENTS

Patent Documents (Patent Document 1) KR 10-1917814 B1

SUMMARY OF THE INVENTION

The present invention is directed to providing a game method for a game machine for ticket output in which a main body, in which a coin slot, a card terminal, and a ticket output unit are formed on a front surface and a hitting device is formed at one side of the front surface, is provided, a rail unit is formed with a set shape on an upper surface of the main body and is formed to be inclined downward toward the front surface of the main body, a puck feeder for supplying pucks to the rail unit is formed at one side of the upper surface of the main body, a score acquisition unit, in which a plurality of score holes are formed in series to correspond to a moving direction of the puck and allow the puck to fly to and enter the score hole, is formed at one end portion of the rail unit, when a coin is inserted or a card is recognized, the puck dropped onto the rail unit through the puck feeder slides toward the one end portion of the rail unit, and in this case, when the puck is hit by the hitting device to discharge the puck to the other end portion of the rail unit, the puck slides along the score acquisition unit in proportion to a hitting force of the hitting device and then flies into any one of the plurality of score holes so that the number of tickets corresponding to the score hole into which the puck flies is displayed on a ticket output amount display, and the number of tickets displayed on the ticket output amount display is output through the ticket output unit.

According to an aspect of the present invention, there is provided a game method for a game machine for ticket output including a first process of inserting a coin into a coin slot formed in a front surface of a main body or recognizing, by a card terminal, a card and dropping and supplying a puck onto a rail unit formed on an upper surface of the main body to be inclined downward toward the front surface of the main body through a puck feeder formed at one side of the upper surface, a second process of hitting the puck, which moves downward toward the front surface of the main body along the rail unit to be positioned at one end portion of the rail unit, by a hitting device formed on the front surface of the main body and forcibly moving the puck along the rail unit, a third process of allowing the puck, which moves along the rail unit, to fly into any one of a plurality of score holes of a score acquisition unit formed in serial at an end portion of the rail unit and displaying the number of tickets corresponding to the score hole, into which the puck flies, through a ticket output amount display formed at a lower end portion of the upper surface of the main body, and the fourth process of outputting the number of tickets corresponding to the ticket output amount display to a ticket output unit formed on the front surface of the main body.

In the first process, when the puck is discharged through the puck feeder, and a switch formed on an inner wall surface of the puck feeder detects whether the puck is discharged, air may be sprayed through a plurality of holes formed along an upper surface of the rail unit to fly the puck positioned on the rail unit and guide the puck to move downward to the one end portion of the rail unit.

In the second process, when the puck is moved to the one end portion of the rail unit and detected by a first sensor installed on a bottom surface of the one end portion of the rail unit, light may be radiated from the first sensor, and upon detecting the puck placed in a correct position, a speaker of an electronic display board formed upright on a rear surface of the main body may output a game start sound, and a signal may be output to the puck feeder to restrict the puck feeder so that the puck is not discharged.

In the second process, when the puck sequentially passes a first pass sensor installed on the rail unit and a second pass sensor installed at the end portion of the rail unit to be close to the puck feeder, the second pass sensor may vibrates one inclination plate, which is provided upright to correspond to a direction of the score hole of the score acquisition unit and is inclined toward the score hole, to prevent the puck moving toward the score hole from being caught around the score hole.

In the second process, when the first pass sensor detects whether the puck is passed once, and the second pass sensor does not detect whether the puck is passed, it may be determined that the puck is caught on the rail unit between the first pass sensor and the second pass sensor so that the first pass sensor and the second pass sensor may output an error signal, and when the first pass sensor detects whether the puck is passed twice, the second pass sensor does not detect whether the puck is passed, and a the first sensor installed on a bottom surface of the one end portion of the rail unit does not detect the puck, it may be determined that the puck is caught between the first sensor and the first pass sensor so that the first sensor and the first pass sensor may output an error signal.

In the second process, when the first pass sensor detects whether the puck is passed twice, the second pass sensor does not detect whether the puck is passed, and a first sensor installed on a bottom surface of the one end portion of the rail unit detects the puck, light may be radiated from the first sensor installed on the bottom surface of the one end portion of the rail unit, and upon detecting the puck placed at a correct position, a speaker formed on the front surface of the main body may output a game start sound, and a signal may be output to the puck feeder to restrict the puck feeder so that the puck is not discharged.

In the third process, when the puck flies into any one of the plurality of score holes of the score acquisition unit, the number of tickets displayed on ticket display boards formed to correspond to the score holes to display different numbers of tickets may be output to the ticket output amount display to display a total amount of tickets allowed to be output on the ticket output amount display.

A bonus notice board, which moves in an upright state toward the plurality of score holes to be positioned at any one of the plurality of score holes, may be formed between the score acquisition unit and the ticket display board to display the number of bonus tickets on the ticket display board corresponding to the score hole at which the bonus notice board is positioned.

When the puck flies into the score hole, the bonus notice board may move to be positioned at another score hole and may display the number of bonus tickets on the ticket display board corresponding to the score hole at which the bonus notice board is positioned.

DETAILED DESCRIPTION OF EXEMPLARY EMBODIMENTS

Hereinafter, embodiments of the present invention will be described in more detail with reference to the accompanying drawings.

Figure 1:
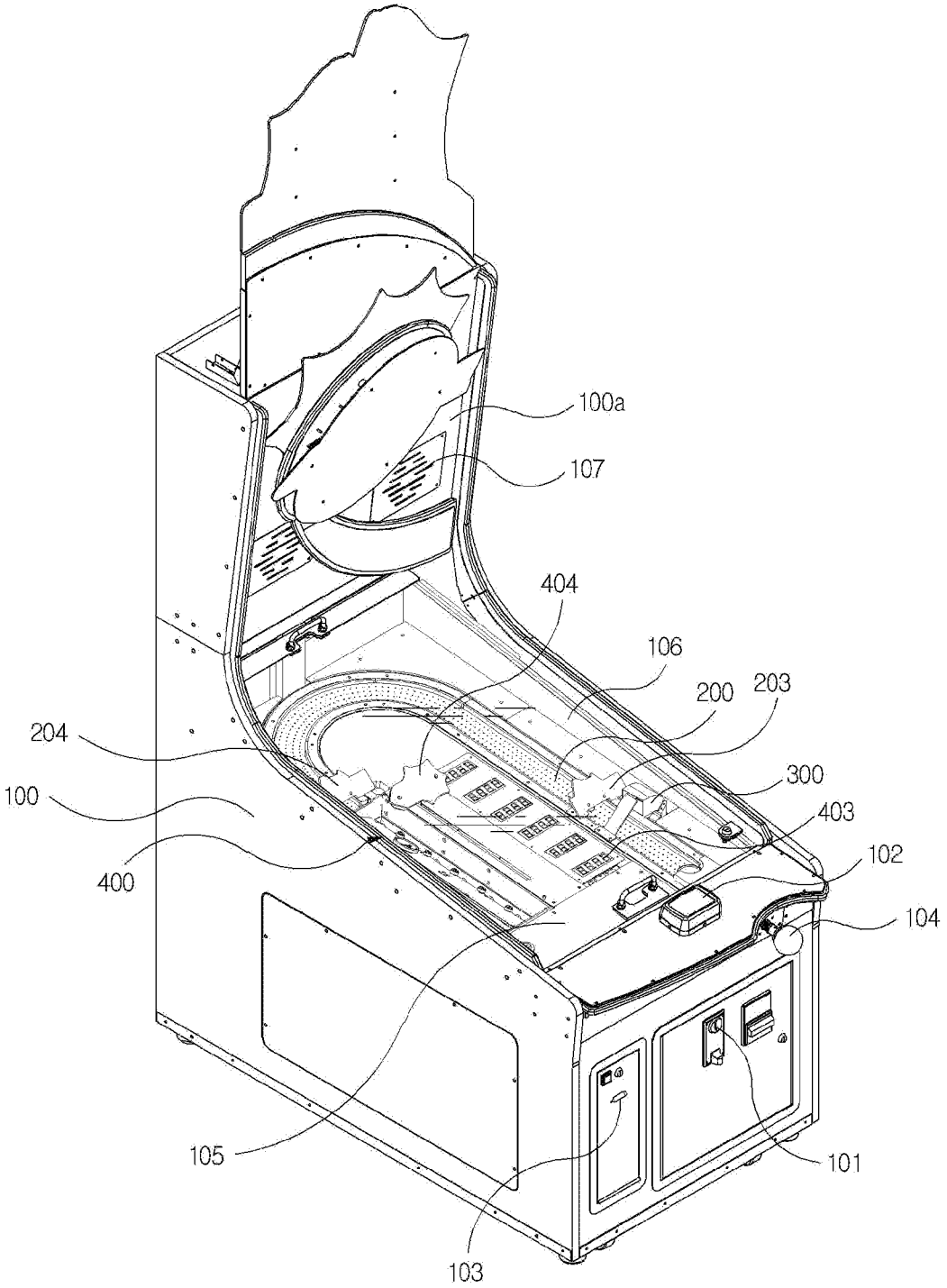
FIG. 1 is a perspective view illustrating a game machine for ticket output according to the present invention.
Figure 2:
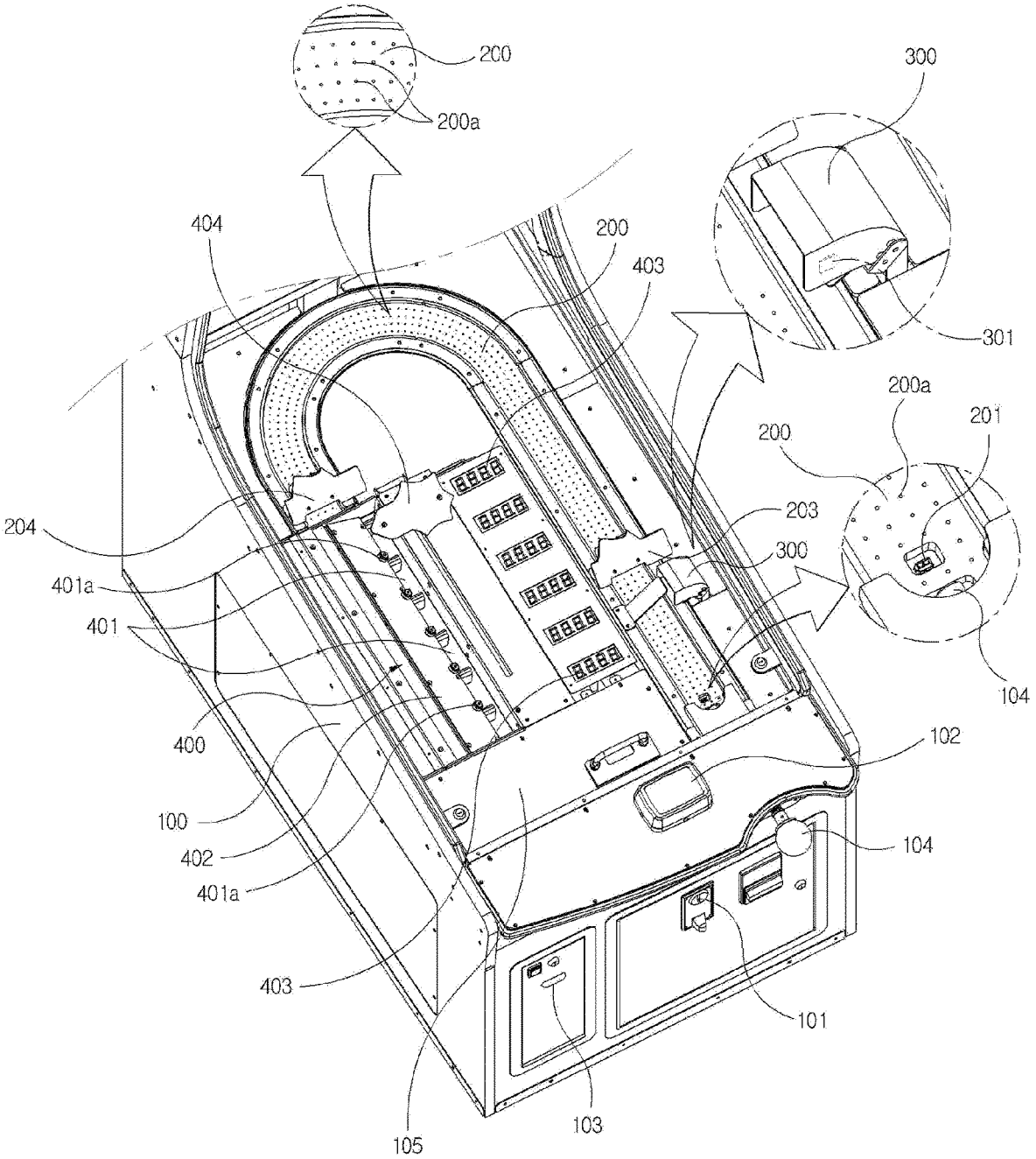
FIG. 2 is a perspective view illustrating a main part of a rail unit of the game machine for ticket output according to the present invention.
Figure 3:
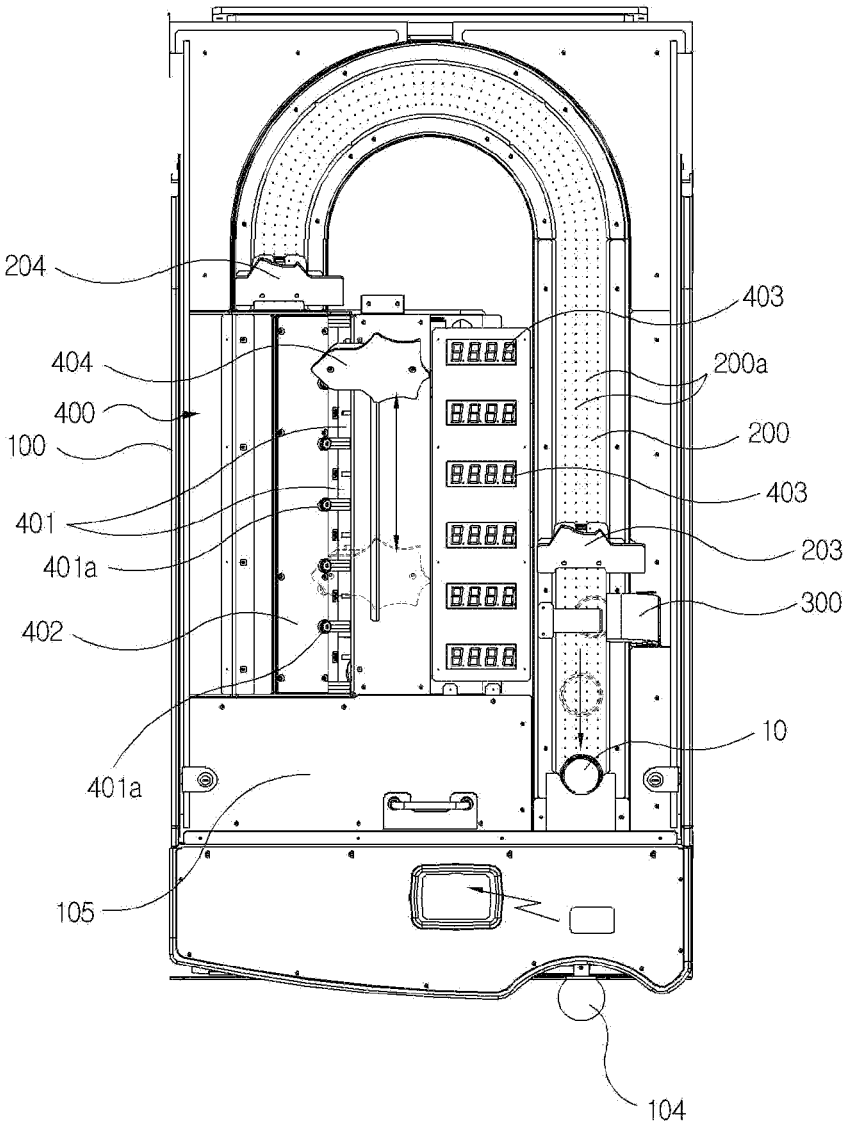
FIG. 3 is a plan view illustrating that a card is recognized by the game machine for ticket output to operate the game machine in a standby state of a game start according to the present invention.
Figure 4:
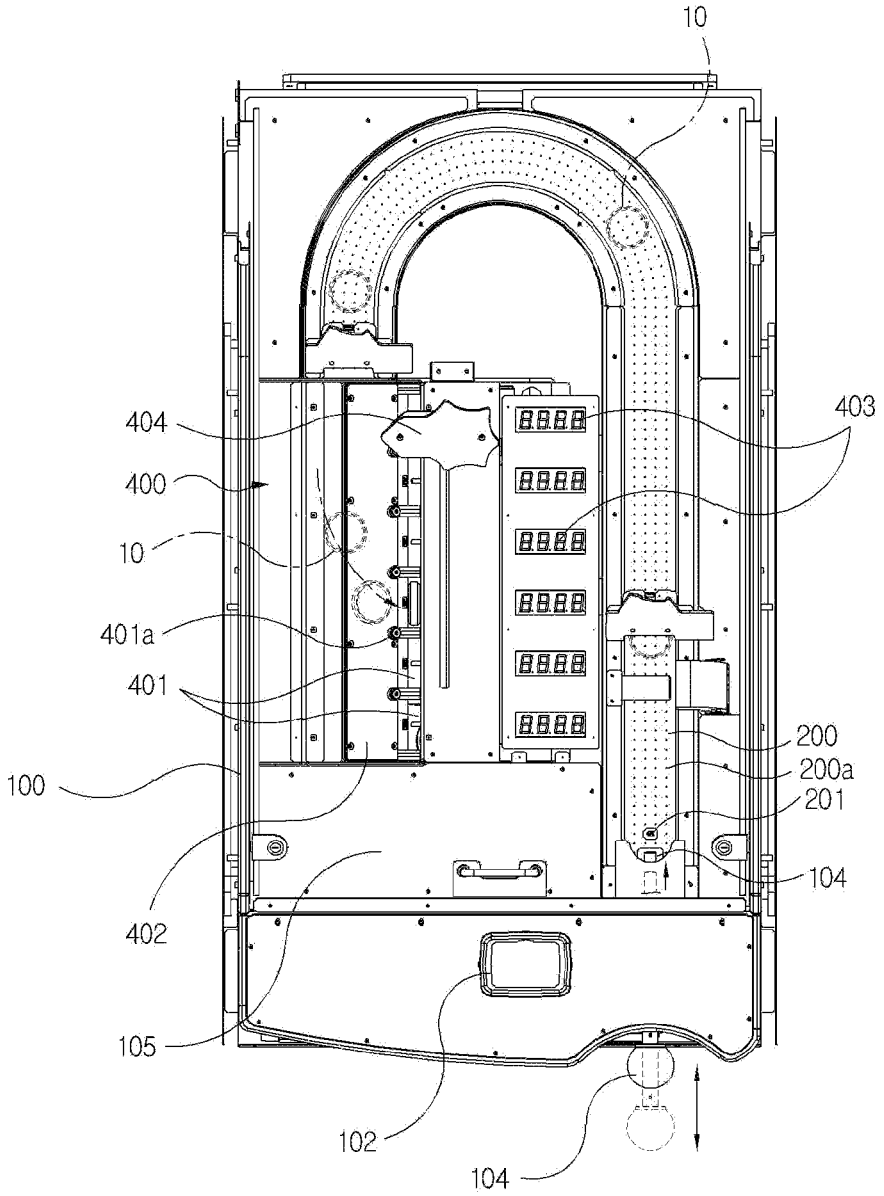
FIG. 4 is a plan view illustrating a state in which a game is played with the game machine for ticket output according to the present invention.
Figure 5:
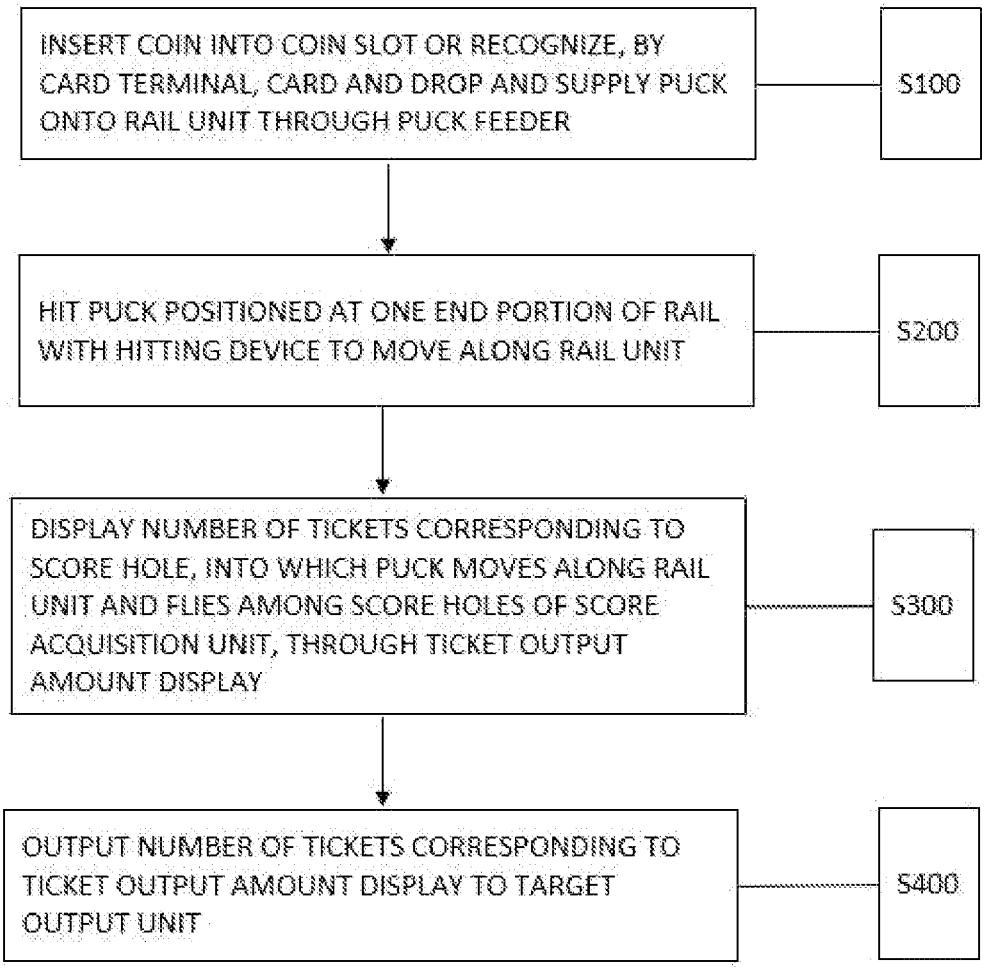
FIG. 5 is a flowchart illustrating a game method for a game machine for ticket output according to the present invention.

Referring to FIGS. 1 to 5, a coin slot 101 for allowing coins to be inserted, a card terminal 102 for recognizing a card, and a ticket output unit 103 for outputting a ticket are formed on a front surface of a main body 100, a hitting device 104 that moves rearward and forward is formed at one side of the front surface, and a ticket output amount display 105 for displaying the number of tickets output through the ticket output unit 103 is formed at a lower end portion of an upper surface of the main body 100.

A viewing window 106 made of a transparent material is formed on the upper surface of the main body 100 to allow a rail unit 200, a puck feeder 300, and a score acquisition unit 400 to be visually checked through the viewing window 106.

When a coin is inserted into the coin slot 101 or a card is recognized by the card terminal 102, the main body 100 outputs a signal to the puck feeder 300.

The ticket output unit 103 outputs the number of tickets corresponding to the ticket output amount display 105.

The hitting device 104 is forcibly moved rearward by being pulled by a user in a state of being gripped by the user, and when the user releases a pulling force, the hitting device 104 restores to the original state thereof to move forward toward one end portion of the rail unit 200 and hit a puck 10 positioned at one end portion of the rail unit 200.

Preferably, one end of the hitting device 104 is exposed at the front surface of the main body 100, and the other end is exposed at one end of the rail unit 200 to move forward or rearward.

The main body 100 further includes an electronic display board 100*a* which is installed upright on a rear surface of the main body 100 and includes a speaker 107 for outputting a sound formed on a front surface thereof.

The electronic display board 100*a* forms a picture, a character, or a figure on a front surface thereof and radiates light to allow the picture, the character, or the figure to emit light.

The speaker 107 receives a signal of a first sensor 201 of the rail unit 200 and outputs a game start sound.

The ticket output amount display 105 displays the sum of the numbers of tickets in each of score holes 401 of the score acquisition unit 400, into which the puck 10 flies, to allow a user to identify the number of tickets to be acquired.

One end portion of the rail unit 200 is formed on the upper surface of the main body 100 at a position corresponding to the hitting device 104 of the main body 100, and the other end portion thereof extends in a direction opposite to the front surface of the main body 100 and is formed with a set shape inclined downward toward the front surface of the main body 100.

The rail unit 200 is formed to be curved to form a curved structure between one end portion and the other end portion thereof and guides the puck 10 to move toward the score acquisition unit 400.

The rail unit 200 receives the puck 10 from the puck feeder 300 and guides the puck 10 to slide toward one end portion of the rail unit 200.

Preferably, a width of the rail unit 200 is relatively greater than a diameter of the puck 10 to guide the movement of the puck 10.

A plurality of holes 200*a*, through which air is sprayed, are formed in the rail unit 200 along an upper surface thereof and flies the puck 10 seated on the rail unit 200 using the air sprayed through the holes 200*a*.

In the rail unit 200, the air sprayed through the holes 200*a* flies the puck 10 to a certain height from a bottom surface of the rail unit 200.

Preferably, light having a set color radiates through the bottom surface of the rail unit 200, and when the puck 10 flies into the score hole 401 of the score acquisition unit 400, the rail unit 200 allows light having a different color from the set color to blink to notify that the puck 10 flies into the score hole 401.

The first sensor 201 is formed to detect whether the puck 10 is present on a bottom surface of one end portion of the rail unit 200.

The first sensor 201 detects the puck 10 positioned at one end portion of the rail unit 200 and outputs a signal to the puck feeder 300 to restrict the puck feeder 300 so that the puck 10 is not discharged.

As soon as the first sensor 201 detects whether the puck 10 is present, light is emitted to notify whether the puck 10 is placed in a correct position to the outside.

Preferably, the first sensor 201 is formed as a light-emitting sensor that emits light, and when the puck 10 is detected, light passes through the rail unit 200 to be emitted to the outside.

The rail unit 200 further includes a first pass sensor 203, which detects whether the puck 10 is passed, formed at a position close to the puck feeder 300 and a second pass sensor 204, which detects whether the puck 10 passing the first pass sensor 203 is discharged, formed at the end portion thereof.

The first pass sensor 203 determines whether the puck 10 separated from the first sensor 201 is passed and identifies a position of the puck 10.

The first pass sensor 203 detects the puck 10 separated from the first sensor 201 and determines that the puck 10 normally moves along the rail unit 200. When the puck 10 separated from the first sensor 201 is not detected, the first pass sensor 203 determines that the puck 10 is caught on a path between the first pass sensor 203 and the first sensor 201 and outputs an error signal.

The second pass sensor 204 determines whether the puck 10 passing the first pass sensor 203 is discharged and identifies a position of the puck 10.

The second pass sensor 204 detects whether the puck 10 passing the first pass sensor 203 is discharged and determines that the puck 10 normally enters the score acquisition unit 400. When the puck 10 passing the first pass sensor 203 is not detected, the second pass sensor 204 determines that the puck 10 is caught between the first pass sensor 203 and the second pass sensor 204 and outputs an error signal.

The puck feeder 300 is fixedly installed at one side of the upper surface of the main body 100 and drops and supplies the puck 10 onto the rail unit 200.

The puck feeder 300 receives a signal of the coin slot 101 or the card terminal 102 and discharges the signal to the rail unit 200.

When the signal of the first sensor 201 is input, the puck feeder 300 stops the supply of the puck 10.

A switch 301 is formed on an inner wall surface of the puck feeder 300 to detect the discharge of the puck 10.

The switch 301 detects that the puck 10 is discharged through the puck feeder 300 and then controls air to be sprayed through the holes 200*a* of the rail unit 200.

The score acquisition unit 400 is formed at the end portion of the rail unit 200 and provided with the plurality of score holes 401 connected in series to correspond to a moving direction of the puck 10. The score acquisition unit 400 allows the puck 10 discharged to the end portion of the rail unit 200 to fly into any one of the plurality of score holes 401.

The score holes 401 are formed to be separated from each other, and when the puck 10 flies into the score holes 401, a different number of tickets are output to the ticket output amount display 105.

A roller 401*a* is further formed between the score holes 401 to rotate at the same place and guide the puck 10 approaching the perimeter of the score hole 401 to fly into the score hole 401.

The roller 401*a* rubs against an outer surface of the puck 10 and guides the puck 10 to fly into the score hole 401.

The score acquisition unit 400 further includes one inclination plate 402 which is provided to be upright to correspond to the score holes 401, is formed to be inclined toward the score holes 401, and guides the puck 10 to move toward the score hole 401.

The inclination plate 402 is connected to the second pass sensor 204 and operates to vibrate at a time point at which the puck 10 passes the second pass sensor 204, thereby preventing the puck 10 form being caught around the score hole 401.

The inclination plate 402 repeatedly vibrates or stops at a set time interval to vibrate the puck 10.

The score acquisition unit 400 includes ticket display boards 403 which are each formed on one side surface of the score hole 401 to correspond to each of the score holes 401 and each display the number of ticket outputs corresponding to each of the score holes 401.

The ticket display board 403 displays the number of tickets obtainable when the puck 10 flies into the score hole 401.

The ticket display board 403 displays different numbers of tickets to allow a user to visually identify the number of tickets obtainable when the puck 10 flies into the score hole 401.

A bonus notice board 404 is further formed to move in an upright state toward the score hole 401 between the score acquisition unit 400 and the ticket display board 403. The bonus notice board 404 is positioned at any one of the plurality of score holes 401 and displays the number of bonus tickets on the ticket display board 403 corresponding to the score hole 401.

When the puck 10 flies into the score hole 401, the bonus notice board 404 moves to another score hole 401 and displays the number of bonus tickets on the ticket display board 403 corresponding to the score hole 401 at which the bonus notice board 404 is positioned.

Preferably, the bonus notice board 404 is restricted from moving to the score hole 401 positioned at the lowest side among the plurality of score holes 401 and prevents a change of the number of tickets on the ticket display board 403 corresponding to the score hole 401 positioned at the lowest side.

Preferably, the number of tickets displayed on the ticket display board 403 corresponding to the score hole 401 at which the bonus notice board 404 is positioned is displayed as the number of tickets that is greater than the number of tickets displayed on the ticket display boards 403 corresponding to the other score holes 401.

Preferably, a position of the bonus notice board 404 is randomly shifted to a position of the plurality of score holes 401 at a time point at which the puck 10 flies into the score hole 401.

The game method for the game machine for ticket output according to the present invention having a configuration as described above is used as follows.

First, when a coin is inserted into the coin slot 101 of the main body 100 or a card is recognized by the card terminal 102 on the main body 100, the coin slot 101 or the card terminal 102 outputs a signal to the puck feeder 300 to discharge the puck from the puck feeder 300, and in this case, the puck 10 discharged from the puck feeder 300 is dropped and supplied onto the rail unit 200 (S100).

Here, as the puck 10 is discharged from the puck feeder 300, the switch 301 formed in the puck feeder 300 operates to allow air to be sprayed through the holes 200*a* of the rail unit 200, thereby maintaining a state in which air is sprayed through the entire upper surface of the rail unit 200.

Then, while the puck 10 dropped onto the rail unit 200 maintains a state of being flown on the rail unit 200 by the air sprayed through the holes 200*a*, the puck 10 slides along the rail unit 200 and moves downward to be positioned at the one end portion of the rail unit 200.

When the puck 10 is positioned at one end portion of the rail unit 200, the first sensor 201 emits light to the outside while detecting the puck 10 and outputs a signal to the puck feeder 300. While light is radiated onto the rail unit 200 on which the puck 10 is positioned, whether the puck 10 is placed in a correct position is notified, and simultaneously, the puck feeder 300 receives the signal of the first sensor 201 to stop the discharge of the puck 10.

In addition, the first sensor 201 outputs a signal to the speaker 107 formed on the display board 100*a* of the main body 100 to output a game start sound through the speaker 107.

Subsequently, the bonus notice board 404 installed in the score acquisition unit 400 moves to a position corresponding to any one of the plurality of score holes 401 and displays the number of bonus tickets on the ticket display board 403 corresponding to the score hole 401 at which the bonus notice board 404 is positioned.

The number of tickets corresponding to another score hole 401 is displayed on the ticket display board 403 corresponding to each score hole 401, and in this case, the numbers of tickets displayed on the plurality of ticket display boards 403 are displayed differently.

Thereafter, in a state in which the hitting device 104 is gripped, when a pulling force is applied to the hitting device 104 to move the hitting device 104 rearward, and then the pulling force applied to the hitting device 104 is released, the hitting device 104 moves forward to hit the puck 10 positioned at one end portion of the rail unit 200, and in this case, the puck 10 slides along the rail unit 200 (S200).

Here, when the puck 10 is hit by the hitting device 104, the puck 10 is separated from the first sensor 201 and then passes the first pass sensor installed on the rail unit 200, and in this case, the first pass sensor 203 determines whether the puck 10 is passed.

In this case, after the puck 10 is separated from the first sensor 201 and the detection of the first sensor 201 is released, when the puck 10 passes the first pass sensor 203, it is determined that the puck 10 normally moves along the rail unit 200. After the detection of the first sensor 201 is released, when the puck 10 is not detected by the first pass sensor 203, it is determined that the puck 10 is caught between the first sensor 201 and the first pass sensor 203, the first sensor 201 and the first pass sensor 203 output an error signal.

However, when the puck 10 is not detected by the first pass sensor 203 after the detection of the first sensor 201 is released, but the puck 10 is detected by the first sensor 201 within a certain time, a game start sound is output through the speaker 107.

Meanwhile, when the puck 10 passing the first pass sensor 203 continuously moves along the rail unit 200 and passes the second pass sensor 204, it is determined that the puck 10 enters the score acquisition unit 400 to determine that the puck 10 normally moves.

When, after the first pass sensor 203 detects the puck 10, the second pass sensor 204 does not detect the puck 10, it is determined that the puck 10 is caught on a path between the first pass sensor 203 and the second pass sensor 204, and the first pass sensor 203 and the second pass sensor 204 output an error signal.

That is, when the first pass sensor 203 detects whether the puck 10 is passed once, and the second pass sensor 204 does not detect whether the puck 10 is passed, it is determined that the puck 10 is caught on the rail unit 200 between the first pass sensor 203 and the second pass sensor 204 so that the first pass sensor 203 and the second pass sensor 204 output an error signal.

When the first pass sensor 203 detects whether the puck 10 is passed twice, the second pass sensor 204 does not detect whether the puck 10 is passed, and the first sensor 201 installed on the bottom surface of one end portion of the rail unit 200 does not detect the puck 10, it is determined that the puck 10 is caught between the first sensor 201 and the first pass sensor 203 so that the first sensor 201 and the first pass sensor 203 output an error signal.

On the other hand, when the first pass sensor 203 detects whether the puck 10 is passed twice, the second pass sensor 204 does not detect whether the puck 10 is passed, and the first sensor 201 installed on the bottom surface of one end portion of the rail unit 200 detects the puck 10, light is radiated onto the bottom surface of the rail unit 200, on which the puck 10 is positioned, through the first sensor 201, upon detecting the puck 10 placed at a correct position, the speaker 107 formed on the front surface of the main body 100 outputs a game start sound, and a signal is output to the puck feeder 300 to restrict the puck feeder 300 so that the puck 10 is not discharged.

Thereafter, after the puck 10 passing the second pass sensor 204 enters the score acquisition unit 400, when the puck 10 moves along the score acquisition unit 400 to fly into any one of the plurality of score holes 401, the number of tickets displayed on the ticket display board 403 corresponding to the score hole 401 into which the puck 10 flies is input to the ticket output amount display 105 (S300).

Here, when the bonus notice board 404 is positioned at the score hole 401 into which the puck 10 flies, the number of bonus tickets displayed on the ticket display board 403 corresponding to the score hole 401 is input to the ticket output amount display 105.

In this case, as soon as the puck 10 passes the second pass sensor 204, the second pass sensor 204 outputs a signal to the inclination plate 402 of the score acquisition unit 400. In this case, while the inclination plate 402 repeatedly vibrates and stops at a set time interval, the inclination plate 402 approaches the score hole 401 to vibrate the puck 10 that moves onto the inclination plate 402, thereby preventing the puck 10 from being caught around the score hole 401.

In addition, while rubbing against the roller 401*a* installed around the score hole 401, the puck 10 vibrated by the inclination plate 402 is guided toward the score hole 401 by the roller 401*a* and flies into the score hole 401.

Subsequently, at a time point at which the puck 10 flies into the score hole 401, the bonus notice board 404 moves to any one of the plurality of score holes 401, and the number of bonus tickets is displayed on the ticket display board 403 corresponding to the score hole 401 at which the bonus notice board 404 is positioned.

In this case, the bonus notice board 404 is restricted from moving to the score hole 401 positioned at the lowest side among the plurality of score holes 401 to prevent a change of the number of tickets on the ticket display board 403 corresponding to the score hole 401 positioned at the lowest side.

When the puck enters the score hole 401, the puck 10 is discharged from the puck feeder 300 to the rail unit 200, and the puck 10 flies into the score hole 401 in the same manner as above.

In particular, a position of the score hole 401 into which the puck 10 flies is changed by a hitting force of the hitting device 104, a pulling force for pulling the hitting device 104 is changed to adjust the hitting force for hitting the puck 10 by the hitting device 104.

Thereafter, tickets corresponding to the number of tickets displayed on the ticket output amount display 105 are output to the ticket output unit 103, and in this case, a user obtains the tickets through the ticket output unit 103 (S400).

As described above, in a structure in which the puck 10 positioned at one end portion of the rail unit 200 is hit by the hitting device 104 to move the puck 10 along the rail unit 200 so that the puck 10 flies into any one of the plurality of score holes 401, when a game is played by hitting the puck 10 through the hitting device 104, a pain can be prevented from occurring in a user's body, and through a method of hitting the puck 10 through the hitting device 104, anyone of any age or sex can easily hit the puck 10 with the same hitting force. In addition, when the puck 10 flies into the plurality of score holes 401 of the score acquisition unit 400, different numbers of tickets corresponding to the score holes 401 are displayed on the ticket output amount display 105 to generate a desire to acquire a larger number of tickets.

According to the present invention, when a game is played by hitting a puck through a hitting device, a pain can be prevented from occurring in a user's body, and through a method of hitting the puck through the hitting device, anyone of any age or sex can easily hit the puck with the same hitting force. In addition, when the puck flies into a plurality of score holes of a score acquisition unit, different numbers of tickets corresponding to the score holes are displayed on a ticket output amount display to generate a desire to acquire a larger number of tickets. It is possible to induce competition with others by generating a competitive desire to acquire the number of tickets. A competitive desire to acquire the number of tickets is generated, thereby inducing e competition with others. In particular, since a bonus notice board is positioned in a different score hole of the score acquisition unit for each game, a relatively large number of tickets can be obtained through the score hole at which the bonus notice board is positioned, thereby inducing interest in the game and improving the reliability of a product at the same time.

The above-described game method for the game machine for ticket output according to the present invention is not limited to the embodiments described above, and its technical spirit lies within the range in which the game method may be variously changed by those skilled in the art without departing from the scope of the claimed invention.

What is claimed is:

1. A game method for a game machine for ticket output, comprising:

a first process (S100) of inserting a coin into a coin slot (101) formed in a front side of a main body (100) or recognizing, by a card terminal (102), a card, and dropping and supplying a puck (10) onto a rail unit (200) by a puck feeder (300) disposed adjacent to the rail unit (200), wherein the rail unit (200) is disposed on an upper side of the main body (100) and is inclined downward toward the front side of the main body (100);

a second process (S200) of hitting the puck (10), which is positioned at a first end portion of the rail unit (200), by a hitting device (104) formed on the front side of the main body (100), such that the puck (10) moves toward a second end portion of the rail unit (200) along the rail unit (200);

a third process (S300) of allowing the puck (10) to exit the rail unite (200) and fly into any one of a plurality of score holes (401) of a score acquisition unit (400), the score acquisition unit (400) being disposed adjacent to the second end portion of the rail unit (200), and displaying a number of tickets corresponding to a score hole (401) into which the puck (10) flies, through a ticket display board (403) formed to correspond to the score hole (401) and a ticket output amount display (105) formed at a lower end portion of the upper side of the main body (100); and a fourth process (S400) of outputting the number of tickets corresponding to the ticket output amount display (105) to a ticket output unit (103) formed on the front side of the main body (100), wherein the third process (S300) further includes:

moving a bonus notice board (404) to one of the plurality of score holes (401), and displaying a number of bonus tickets on the ticket display board (403) corresponding to the one of the plurality of score holes (401) at which the bonus notice board (404) is positioned, wherein the bonus notice board (404) is disposed between the score acquisition unit (400) and ticket display boards (403) and configured to move in parallel with the plurality of score holes (401).

2. The game method of claim 1, wherein, in the first process (S100), when the puck (10) is discharged through the puck feeder (300), and a switch (301) formed on an inner wall surface of the puck feeder (300) detects whether the puck (10) is discharged, air is sprayed through a plurality of holes (200a) formed along an upper surface of the rail unit (200) to fly the puck (10) positioned on the rail unit (200).

3. The game method of claim 2, wherein, in the second process (S200), when the puck (10) is detected by a first sensor (201) installed on a bottom surface of the first end portion of the rail unit (200), a speaker (107) outputs a game start sound, and a signal is output to the puck feeder (300) to prevent another puck from being discharged from the puck feeder (300).

4. The game method of claim 1, wherein, in the second process (S200), when the puck (10) sequentially passes a first pass sensor (203) installed on the rail unit (200) near the puck feeder (300) and a second pass sensor (204) installed at the second end portion of the rail unit (200), the second pass sensor (204) triggers vibration of an inclination plate (402), which is provided upright to correspond to a direction of the score hole (401) of the score acquisition unit (400) and is inclined toward the score hole (401), to prevent the puck (10) moving toward the score hole (401) from being caught around the score hole (401).

5. The game method of claim 4, wherein, in the second process (S200), when the first pass sensor (203) detects the puck (10) once, but the second pass sensor (204) does not detect the puck (10) within a predetermined time, it is determined that the puck (10) is caught on the rail unit (200) between the first pass sensor (203) and the second pass sensor (204) so that the first pass sensor (203) and the second pass sensor (204) output an error signal, and when the first pass sensor (203) detects the puck (10) twice, but the second pass sensor (204) does not detect the puck (10) within the predetermined time, and a first sensor (201) installed on a bottom surface of the first end portion of the rail unit (200) does not detect the puck (10) within the predetermined time, it is determined that the puck (10) is caught between the first sensor (201) and the first pass sensor (203) so that the first sensor (201) and the first pass sensor (203) output an error signal.

6. The game method of claim 4, wherein, in the second process (S200), when the first pass sensor (203) detects the puck (10) is twice, but the second pass sensor (204) does not detect the puck (10) within a predetermined time, and a first sensor (201) installed on a bottom surface of the first end portion of the rail unit (200) detects the puck (10) within the predetermined time, a speaker (107) outputs a game start sound, and a signal is output to the puck feeder (300) to prevent another puck from being discharged from the puck feeder (300).

7. The game method of claim 1, wherein, when the puck (10) flies into the score hole (401), the bonus notice board (404) is configured to randomly shifted to another score hole (401) and displays the number of bonus tickets on the ticket display board (403) corresponding to the another score hole (401) at which the bonus notice board (404) is positioned.

* * * * *